US007043894B2

(12) United States Patent
Wuest et al.

(10) Patent No.: US 7,043,894 B2
(45) Date of Patent: May 16, 2006

(54) AIR SPINNING FRAME WITH RELUCTANCE MOTORS

(75) Inventors: Oliver Wuest, Seuzach (CH); Wolf Horst, Holzheim (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/652,579

(22) Filed: Aug. 29, 2003

(65) Prior Publication Data

US 2004/0107688 A1 Jun. 10, 2004

(30) Foreign Application Priority Data

Sep. 16, 2002 (CH) ..... 1569/02

(51) Int. Cl.
*D01H 4/42* (2006.01)

(52) U.S. Cl. ..... 57/400; 57/317; 57/93

(58) Field of Classification Search ..... 57/263–265, 57/400–417, 333, 350, 78, 92, 97, 100, 93, 57/317

See application file for complete search history.

(56) References Cited

U.S. PATENT DOCUMENTS 4,336,684 A 6/1982 Hartmannsgruber et al.
5,015,938 A * 5/1991 Oehler et al. ..... 318/696
5,161,361 A * 11/1992 Talley et al. ..... 57/264
5,400,582 A * 3/1995 Hartmeier et al. ..... 57/264
5,535,481 A * 7/1996 Hartmeier et al. ..... 19/260
5,857,496 A * 1/1999 Brown et al. ..... 139/110
5,927,062 A * 7/1999 Deno et al. ..... 57/333
6,198,183 B1 * 3/2001 Baeumel et al. ..... 310/52
6,412,266 B1 7/2002 Paweletz et al.
2002/0124545 A1 9/2002 Griesshammer et al.

FOREIGN PATENT DOCUMENTS

DE 19637757 4/1997

OTHER PUBLICATIONS

EPO Search Report, Jul. 20, 2001.

* cited by examiner

*Primary Examiner*—John J. Calvert
*Assistant Examiner*—Shaun R. Hurley
(74) *Attorney, Agent, or Firm*—Dority & Manning, P.A.

(57) ABSTRACT

For an air spinning frame, reluctance motors are provided for each spinning place to drive the pairs of rollers of the drafting unit, the drawing-off means, and the friction roller. Thereby, for the run-up of a spinning place, e.g., after a thread break, a specific frequency converter is provided. After reaching the stationary operating speed, a switch over onto a further frequency converter takes place, at which time, the corresponding reluctance motors of the other spinning places are driven in parallel. By the use of reluctance motors it can be done without a complex speed regulation means. A specific dimensioning of the reluctance motors permits a very fast run-up and a particularly good efficiency during the stationary operation.

19 Claims, 3 Drawing Sheets

AIR SPINNING FRAME WITH RELUCTANCE MOTORS

BACKGROUND OF THE INVENTION

The present invention relates to an air spinning frame as well as to a method for the operation of an air spinning frame.

Air spinning frames comprise a large number of spinning places. Thereby, in each spinning place, a thread is spun from a supplied longitudinal fibre formation. The spinning procedure is affected by means of the drafting unit in which the fibre amount per unit of length is reduced by the drafting process. For this, the drafting unit usually comprises three pairs of rollers, arranged one behind the other, whose circumferential speed increases from pair of rollers to pair of rollers. Thereafter, the longitudinal fibre formation, refined in such a way, is spun into a thread in a spinning nozzle by twisting. Air spinning frames use the air spinning method for the thread formation, i.e., the thread formation takes place by air twisting. Thereafter, the thread is drawn off by means of a further pair of rollers and finally wound onto a yarn package. This yarn package is preferably driven by means of a friction roller, which itself is connected with a motor.

After a thread break or a required change of the yarn package, the spinning procedure must again be started (pieced) newly. For a production interruption that is as short as possible, it is required that the pairs of rollers of the drafting unit and of the draw-off means, as well as also of the friction roller, run-up very fast and/or practically instantaneous. A quasi-instantaneous run-up does mean that the operating speed must be reached within a very short time, for example, within 1 to 2 seconds. Beyond that, with a fast run-up, a certain quality of piecing is thereby also ensured.

In the U.S. patent application, US 2001/0042365 A1 (PAWELETZ, Anton; BAHLMANN, Bernd; BOCK, Erich; SCHULLER, Edmund), a spinning frame with several individual drives is disclosed, where a synchronous motor is applied. One of the motors thereby serves as "Lead motor", so that from its speed, by means of a control means/regulation means, the other motors are controlled accordingly. Such permanently excited motors are, however, not very common because of the accommodation of the magnet.

In the disclosure EP 1 205 588 A1 (Maschinenfabrik Rieter AG), a spinning frame is disclosed, in which the drafting unit of a spinning place is at least partly controllable and drivable independent of the drafting unit of the other spinning places, whereby for each spinning place, at least one sensor means is provided. A relatively complex regulation means for each spinning place is, however, necessary, since the run-up method of the motors must be monitored indirectly by means of the mentioned sensor means.

OBJECTS AND SUMMARY OF THE INVENTION

It is a principal object of the present invention to provide an air spinning frame and a method for the operation of an air spinning frame, so that, for each spinning place, an individual run-up can be accomplished and that no regulation means are required for this. The required control means is to be, with regard to the switch over circuit, arranged in a simple manner and is to permit a precise and very fast run-up. Beyond that in the stationary operation, a higher efficiency rate is to be achieved. Additional objects and advantages of the invention will be set forth in part in the following description, or may be obvious from the description, or may be learned through practice of the invention.

By the use of reluctance motors to drive the rollers of a spinning place a regulation means is not required, since reluctance motors are characterized by the feature that their speed is synchronous with the frequency supplied to them. Due to mass-free tooth gaps—between the rotor teeth—in the outer zone of the rotor, the reluctance motor comprises a relatively low moment of inertia and is, therefore, particularly suitable for the drive of the pairs of rollers, since these must accelerate to an operating speed within a very short time. A further advantage of the invention results from the fact that, for air spinning frames, only a speed-accurate, however not an angular-accurate run-up, is required. This requirement can be fulfilled in a simple way with non-controlled reluctance motors.

The invention is described in more detail in the following by way of examples of the drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
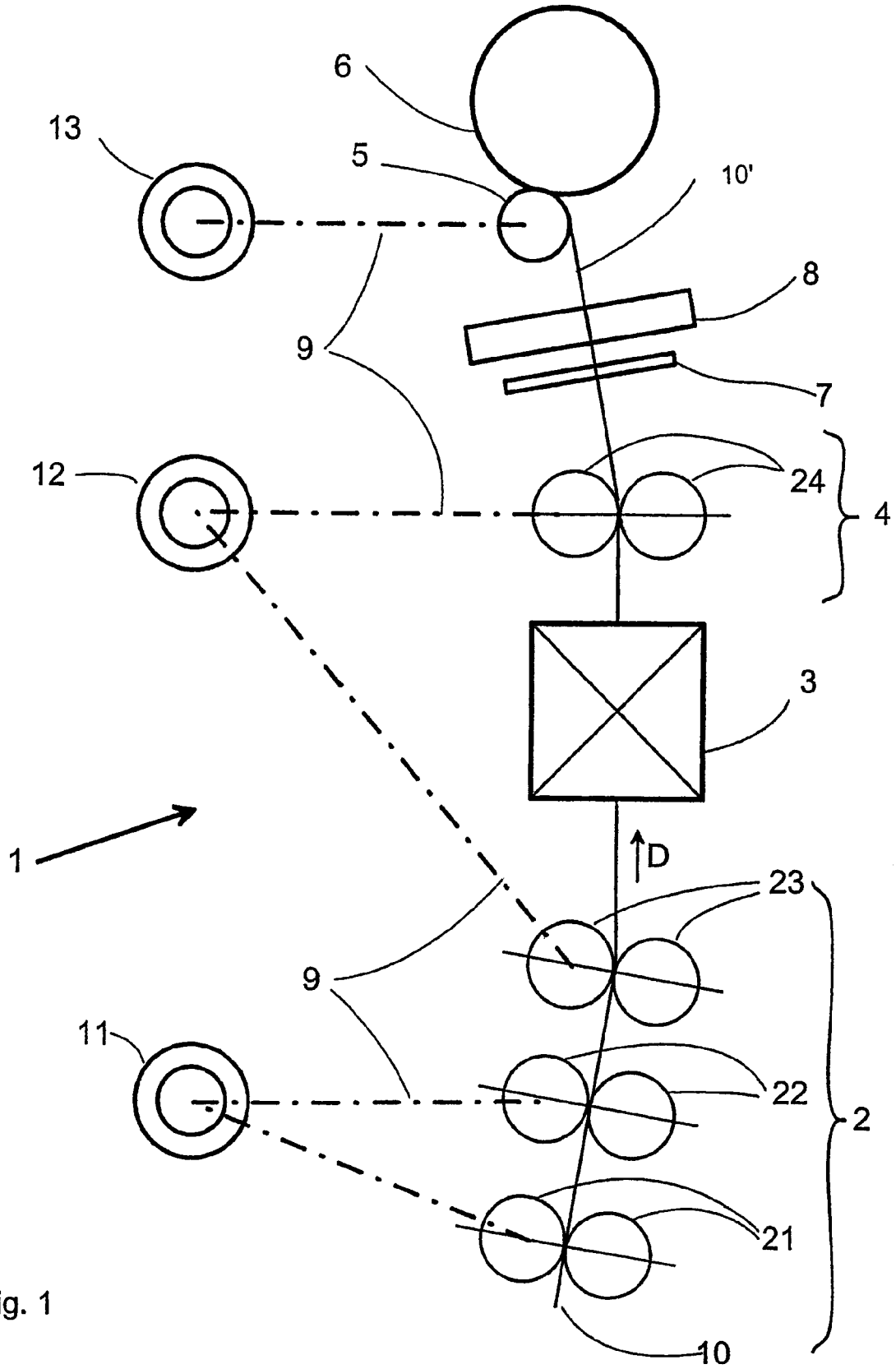
FIG. 1 shows a principle illustration of a spinning place of an air spinning frame with the assigned reluctance motors.

An air spinning frame comprises a multiplicity of spinning places 1. FIG. 1 shows, in an illustration, a single spinning place 1 with drafting unit 2, spinning box 3, draw-off means 4, and yarn package 6. The drafting unit 2 is formed by three pairs of rollers 21, 22, and 23, which, in spinning direction D, comprise a step-by-step larger peripheral speed:

$$v1<v2<v3,$$

in order to refine the supplied longitudinal fibre formation 10.

The thread 10' produced in the spinning box 3 is transported-off by means of a pair of rollers 24 of the draw-off means 4 and is wound onto the yarn package 6 by means of a friction roller 5. A thread shifting device 8 serves for an appropriate winding by shifting the thread back and forth, depending on the rotational speed of the yarn package 6. The spinning procedure is monitored by a thread sensor 7, which, in case of a possible thread break puts the respective spinning place out of operation. The aforementioned pairs of rollers 21, 22, 23, and 24 as well as the friction roller 5 are driven by the assigned reluctance motors 11, 12, and 13 through the drive connections 9. Reluctance motors are electric motors which comprise a coil-free rotor with rotor teeth and whose speed behavior during the synchronous operation is directly proportional to the frequency of the supplied voltage. The magnetic rotary field to be formed in the stator of a reluctance motor is generated by three-phase voltages, which, with regard to the timed course, are shifted to each other in each case by 120°. For this, the stator comprises three coils, which are arranged symmetrically offset to one another. A two-phase operation and accordingly two coils on the stator would also be conceivable. Thereby, the voltages to be supplied are offset to each other by 90° or 180°. The rotor of a reluctance motor consist only of a sheet metal package and the shaft. The allocation of the reluctance motors 11, 12, and 13 to the pairs of rollers 21, 22, 23, and 24 in FIG. 1 is to be understood only as an exemplary. It is also possible that one reluctance motor drives also only one pair of rollers of a spinning place 1.

Figure 2:
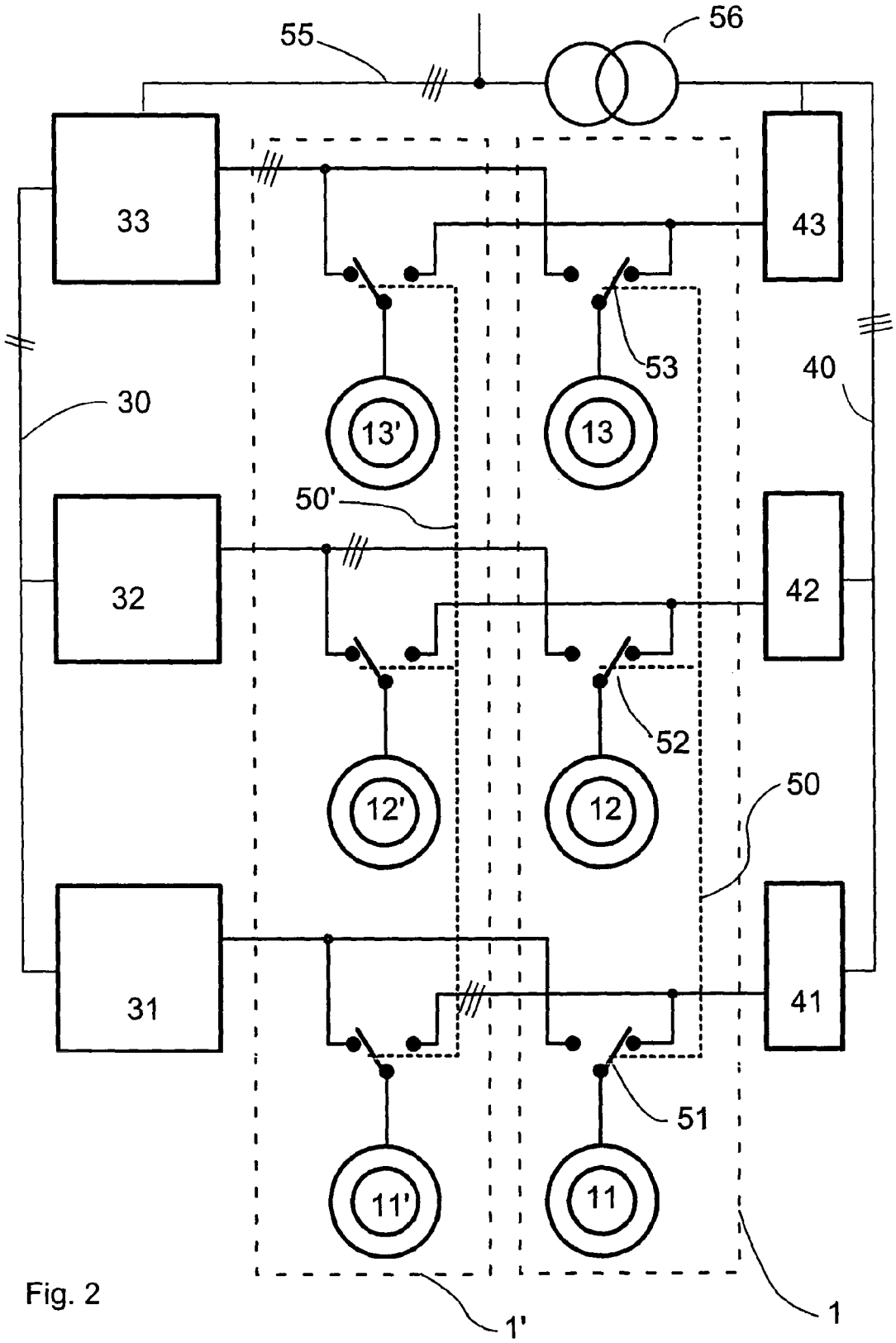
FIG. 2 shows a principle circuit layout to supply the reluctance motors with electric energy.

FIG. 2 shows the drive system for an air spinning frame according to the invention with frequency converters (or changers) for the feeding (the power supply) of the reluctance motors. This overall illustration is based on two spinning places 1 and 1' (dashed lined rectangles) of an air spinning frame, whereby the spinning place 1' is shown during the stationary operation and the spinning place 1 during the phase of piecing and/or during the run-up mode. Naturally, for an air spinning frame more than merely two spinning places are provided. In FIG. 2, it is assumed that several spinning places 1', . . . , are in stationary operation mode at the same time. The second frequency converters (or changers) 31, 32, and 33 supply the assigned reluctance motors 11', 12', and 13' with an electrical operating voltage and a predetermined frequency. Since each of the different spinning places 1, 1', . . . is laid out identically, the corresponding reluctance motors 11 and 11', 12 and 12' as well as 13 and 13' can be switched parallel and be supplied with electric energy from a second frequency converter 31 and/or 32 and/or 33 each.

The motors 11, 11', 12, 12', 13, and 13' operate with the rollers of the air spinning frame as follows:

Reluctance motors 13, 13' . . . drive the friction rollers 5 of the spinning places 1, 1' . . . ;

Reluctance motors 12, 12', . . . drive the pair of rollers 24 of the draw-off means 4 and the pair of rollers 23 of the drafting unit 2 of the spinning places 1, 1' . . . ; and Reluctance motors 11, 11' . . . drive the pair of rollers 21 and 22 of the drafting unit 2 of the spinning places 1, 1' . . . .

The second frequency converters (or changers) 31, 32, and 33 are supplied with electric energy by means of the bus bar 55. Thereby, in this embodiment, the other frequency converters 31 and 32 are supplied from the frequency converter 33 by means of a direct current intermediate circuit 30. The first frequency converter (or changers) 41, 42, and 43 are connected on a common feeder 40 and are fed by means of a transformer 56. Thereby, several voltages can be supplied to the frequency converters 41, 42, and 43. In a further embodiment, the transformer 56 is provided as a so-called autotransformer. A control of the frequency converters 31, 32, and 33 for the stationary operation is required to the extent that the stationary operating speeds, which have to be adapted to the respective spinning load (material, the kind of the thread to be spun, etc.), must be predetermined. For this, a predetermineable reference variable input (not illustrated in FIGS. 1 and 2) is applied.

According to FIG. 1, it is assumed that the spinning place 1 is in a transient mode of the run-up. To supply the reluctance motors 11, 12, and 13 of a spinning place 1 (or 1', . . . ) during the phase of the run-up, separate first frequency converters 41, 42, and 43, assigned to these reluctance motors 11, 12, and 13, are provided. These assigned first frequency converters 41, 42, and 43 are preferably dimensioned in such a way, that they can supply the reluctance motors 11, 12, and 13 of only one spinning place 1 (or 1'; . . . ) at the same time. With a control means (not illustrated in FIG. 2), the run-up parameters are preset as command variable input, thus the reluctance motors 11, 12, and 13 can reach the operating speed within the required time. This control means thereby also presets the command variable inputs for the second frequency converters 31, 32, and 33 during the stationary operation mode. Immediately after reaching the operating speed $n_{D0}$, $n_{W0}$, a switch over of the power supply, from the assigned first frequency converters 41, 42, and 43 to the second frequency converters 31, 32, and 33, takes place. For this, the switches 51, 52, and 53 are used. These switches are actuated by means of a coupling 50. A particularly advantageous design of the coupling 50 is described further down with reference to FIG. 4. The switches 51, 52, and 53 themselves can be of galvanic type, i.e., they can be switches provided with contacts or also electronic switches on the basis of semiconductor type power circuit breakers. It is important that this is a fast switch over. According to the design of the switches 51, 52, and 53, the coupling 50 can be realized mechanically, electrically, or electronically. The switches 51, 52, and 53 in FIG. 2 are illustrated separately. This is not a prerequisite; the switches 51, 52, and 53 can be accommodated in a single mechanical or electronic shuttle.

Figure 4:
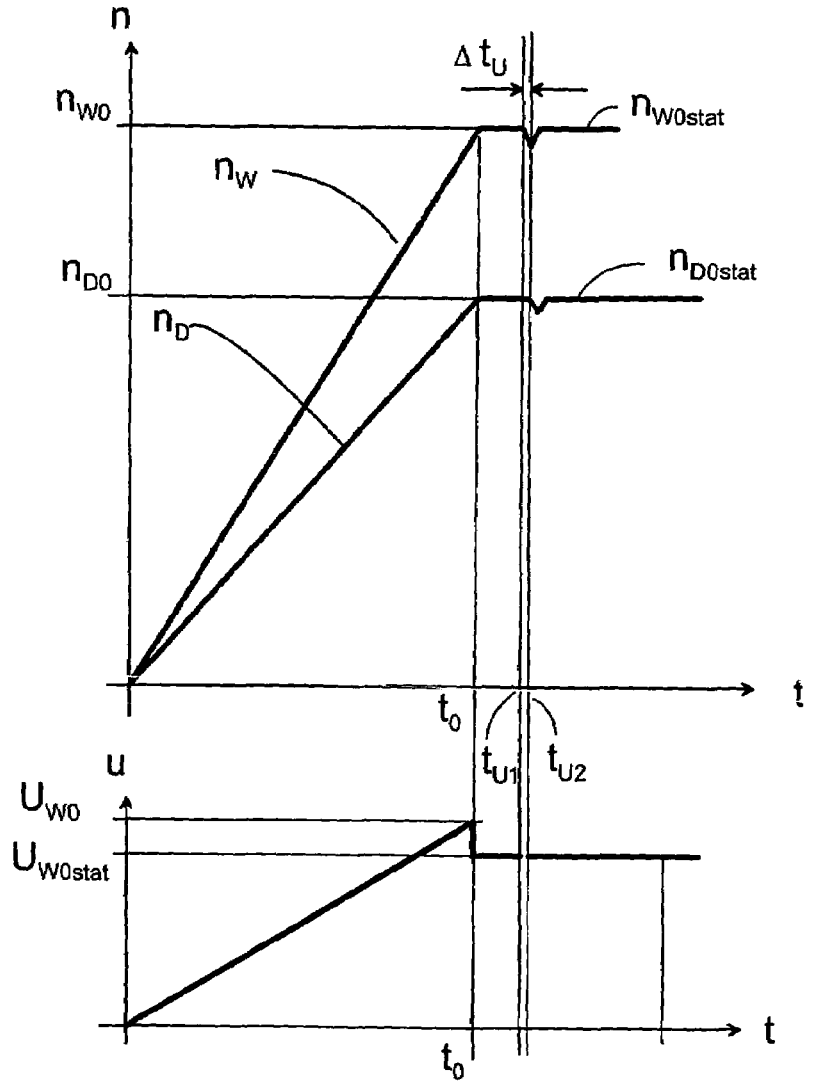
FIG. 4 shows the course of the speeds and the supplied voltage of the reluctance motors during the run-up and switch over.

For the explanation of the run-up itself, FIG. 4 illustrates the time dependent course of the speed $n_W$ of the friction roller 5 for the winding of the thread and/or the speed $n_D$ of the assigned reluctance motor 13 and the pairs of rollers 24 and 23, between which the thread formation takes place and/or the assigned reluctance motor 12. The speeds are accordingly marked with $n_W$ and $n_D$, whereby these parameters represent a function of the time:

$$n_W := n_W(t); \text{ and}$$

$$n_D := n_D(t).$$

The following explanations accordingly are also valid for the reluctance motor 11, even if this motor and the corresponding pairs of rollers 21 and 22 are not being mentioned explicitly in the following description. The reluctance motors 12 and 13 run synchronously up to the operating speeds $n_{w0}$ and $n_{D0}$ with the applied frequency. In the frequency changers 42 and 43, a three-phase voltage is generated, whose frequency rises from 0 cycles per second (cps) up to the corresponding operating frequency of, e.g., 235 cycles per second for the reluctance motor 13. The rise is preset by the required run-up period of, for example, $t_0$=1 . . . 2 seconds, as command variable input for the run-up. The specification of the operating frequency is also merely to be understood as an exemplary specification. For each reluctance motor of a spinning place, another operating frequency is to be provided. These operating frequencies lie, therefore, within a relative wide range of, for example, 95–300 cycles per second. For the run-up, it is important that the voltage-frequency ratio for each reluctance motor remains constant over the duration of the run-up period 0 . . . $t_0$.

In the lower part of FIG. 4, the voltage curve u=u(t) is illustrated for the reluctance motor 13 and/or the assigned frequency converter 43. Due to the aforementioned constant voltage frequency ratio, the voltage rises linear with the time, up to the value $U_{W0}$ when it reaches the operating speed $n_{W0}$. Immediately after reaching it, the voltage can be reduced to a value $U_{W0stat}$. At or after reaching the operating speeds $n_{W0}$ and $n_{D0}$ during the run-up, the switch over onto the frequency changers 32 and 33 takes place for the stationary operation. For the point of time of the switch over $t_U$ and/or $t_{U1}$ and $t_{U2}$, the relation (see FIG. 4) $t_0 \leqq t_U$ applies.

By means of the illustration in FIG. 4, two particularly advantageous switch over modes and thus a specific coupling of the switches 52 and 53 are described. During the switch over procedure, it can be the case that the friction roller 5, together with the yarn package 6, experiences a less strong a speed reduction than the pair of rollers 24. This is based on the larger moment of inertia of the friction roller 5 and the yarn package 6 and thus by the larger stored kinetic energy. The consequence is a tensioning of the thread 10 and thus the danger of thread breaks is relatively high.

In a first embodiment, this thread tensioning is prevented as follows: the switch over of the reluctance motor 13 for the friction roller takes place at an earlier point of time $t_{U1}$. Only at the point of time $t_{U2}=t_{U1}+\Delta t_U$.docs the reluctance motor 12 for the pair of rollers 24 of the draw-off means 4 get switched over onto the frequency converter 32 for the stationary operation. Typical values for $\Delta t_U$ are within the order of magnitude of milliseconds. During the stationary operation, the reluctance motors 13 and 12 comprise the operating speed $n_{W0stat}$ and/or $n_{D0stat}$.

In a second embodiment for the prevention of a thread tensioning during the switch over, the operating speed of one of the reluctance motors 12 for the draw-off means 4 is selected somewhat higher during the run-up mode than during the stationary operation mode: $n_{DO}>n_{D0stat}$. Typical values—expressed in a speed instead of in a number of rotations—are thereby within the range of, e.g., 610 m/min to 600 m/min. During the switch over, an unwanted additional thread tensioning can be prevented in this way. Additionally, for reasons of dynamics, the operating speeds $n_{W0}$ and $n_{W0stat}$ can be preset differently accordingly (not illustrated in FIG. 4).

The two aforementioned embodiments for the switch over can also be combined and are accordingly also applicable on the other pairs of rollers for the prevention of an additional unwanted thread and/or fibre material tensioning. For both aforementioned switch over modes, the finite times for the reduction of the magnetic flow in the reluctance motors are to be considered additionally.

In both embodiments for the switch over, the reluctance motors do not run-up synchronized and/or asynchronously during the power supply from the frequency changers 31, 32, and 33 for the stationary operation, e.g., from a velocity value of, e.g., 580 m/min to 600 m/min. The aforementioned frequency changers 31, 32, and 33 supply a voltage with the constant operating frequency, since all corresponding reluctance motors of the air spinning frame are fed parallel from only one frequency changer. In a further advantageous embodiment, it can be provided that, before the beginning of the run-up, a direct current voltage is supplied to individual or to all reluctance motors of a spinning place. Thereby, a defined starting position of the reluctance motors 11, 12, and 13 and/or the pair of rollers 21, 22, 23, 24 driven by them and the friction roller 5 can be reached.

Figure 3:
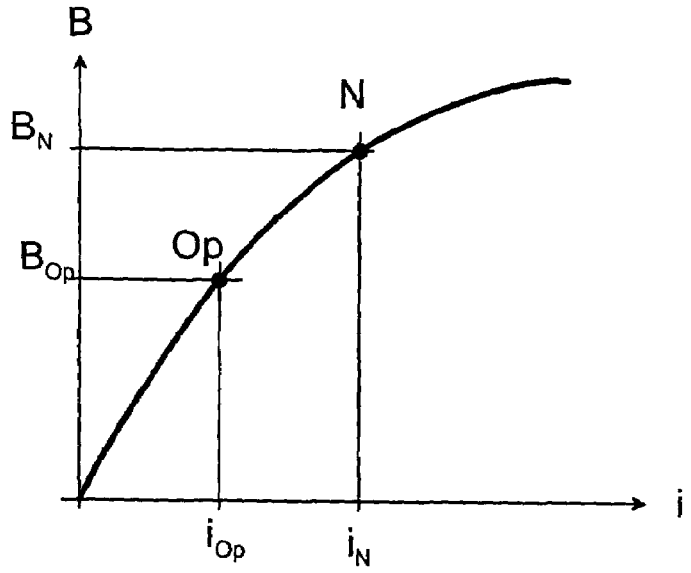
FIG. 3 shows a qualitative illustration of the position of the operating point ($i_{Op}$,$B_{Op}$) concerning the magnetization for the reluctance motors in an air spinning frame according to the present invention.

The magnetic and electrical dimensioning of a reluctance motor is illustrated in FIG. 3. The magnetic induction B resulting in the rotor of a reluctance motor is illustrated by means of the supplied current i with the typical course of saturation. The operating point Op of a reluctance motor for the air spinning frame according to the invention is clearly below the usual nominal point N. This nominal point N is usually in each case determined by the manufacturer, said is done directly before the beginning of the saturation, thereby the nominal values, e.g., the moment of torque are guaranteed by the manufacturer. The aforementioned selection of the operating point Op in relation to the nominal point N permits, in a specific embodiment, the obtaining of the demanded high moment of torque for the run-up, so that the voltage delivered by the further frequency changers 41, 42, 43, and, thus, the current i, is clearly excessive in relation to the operating voltage and/or operating current $i_{Op}$ of the reluctance motors, i.e., approximately up to the value $i_N$ (see FIG. 3 for this). The order of magnitude of excessiveness lies approximately at the factor 1.5:

$$i_N \approx 1.5 \cdot {}_{Op}$$

The moment of torque M delivered by a reluctance motor is determined outside of the saturation range by the following linkage:

$$M=C.u2.7,$$

Thereby mean:

C=motor type-specific constant within the linear range of the induction B (see FIG. 3); and u=the voltage supplied to the respective reluctance motor (averaged instantaneous value).

By this dimensioning of the reluctance motors, the demanded high moment of torque M is achieved. If the operating point Op were approximately at the usual position of the nominal point N of a reluctance motor, then the voltage could actually be increased likewise. This could, however, not lead to the demanded moment of torque M because of the occurring saturation effects. The aforementioned dimensioning of the reluctance motors for the air spinning frame according to the invention comprises a better rate of efficiency in relation to a reluctance motor, whose operating point Op is selected by the manufacturer on the usually, preset nominal point N. This is based on the operation within the still to some extent linear range of the magnetic induction B in relation to the current I; see the qualitative illustration in FIG. 3 for this. A higher degree of efficiency, with regard to air spinning frames, has the great advantage that in the respective spinning halls less dissipated heat has to be removed In addition to the aforementioned electrical and/or magnetic dimensioning of the reluctance motors, the load conditions of the different parts of an air spinning frame have to be considered. For the dimensioning of the reluctance motor 13 for the drive of the yarn package 6 by means of the friction roller 5, a relatively high moment of inertia and a relatively low load are to be considered. In contrast to this, for the reluctance motors 11 and 12, to drive the drafting unit 2, an average moment of inertia of the pairs of rollers 21, 22, and 23 to be driven, a relative high load is to be included in the configuration.

The aforementioned dimensioning of the reluctance motors is independent of the operating method based on this.

For the air spinning frame according to the invention, it is, in a particularly advantageous further embodiment, intended to use the frequency changers and the reluctance motors connected to it, in the four-quadrant operation mode. In case of failure of the energy supplied by way of the bus bar 55, the air spinning frame can be run down in a defined manner. If such failure occurs, the kinetic energy, stored by the moment of inertia of the yarn package 6 and the friction roller 5, is supplied from the assigned reluctance motors 13, 13', . . . (now they are actually generators) by means of the frequency converter 33 to the direct current intermediate circuit 30, so that the other reluctance motors 11 and 12 can be fed with electric energy from the respective frequency changers 31 and 32. Thereby, a synchronous running down of the air spinning frame can be enforced. This procedure, because of the synchronous mode of operation, does not require a regulation and, in particular, no tachometers with regard to the speeds of the individual motors/generators. To the individual frequency changers 31 and 32, a command variable input is to be supplied from a control means, which is configured as a function of time. This command variable input can be derived from the parameters frequency, voltage and current, given in the frequency converter 33 starting from the reluctance generators 13 and can define the running down of an air spinning frame according to the invention. In a specific configuration of the running down procedure, it can be provided that the voltage in the direct current intermediate circuit 30 is kept constant over the time by means of a regulation. The aforementioned mode of operation can also be applied to bypass a brief voltage failure on the bus bar 55. Thereby, it is possible to bypass such cases without thread breaks.

In order to relieve the air conditioning system of a hall, the reluctance motors can be furnished with a water-cooling means or a water-cooling unit. The water used for the cooling circulates within the stator carrying the coil of the reluctance motors.

The aforementioned allocation of the reluctance motors 11, 12, 13 to the individual rollers 21, 22, 23, 24, and 5 and to the frequency changers 31, 32, and 33 is to be understood only as exemplary for the present invention. In particular, for the generator-type operation during the running down reluctance motors 13 other than the ones mentioned can be applied.

Therefore, from the described embodiments, further advantageous arrangements and combinations are easily derivable, which are also comprised in the idea of the invention.

It will be appreciated by those skilled in the art that various modifications and variations can be made in the present invention without departing from the scope of the invention. It is intended that the present invention include such modifications and variations as come within the scope of the appended claims and their equivalents.

The invention claimed is:

1. An air spinning frame having a plurality of spinning places for the production of spun thread from a supplied longitudinal fiber formation, each of said spinning places comprising:

a drafting unit having at least two pairs of drafting rollers, said drafting units drafting said longitudinal fiber formation;

a pair of drawing-off rollers positioned downstream from said drafting unit in a direction of travel of a formed thread created from fibers discharged from said drafting unit, said pair of drawing-off rollers transporting said thread after the formation of said thread;

a friction roller positioned downstream from said pair of drawing-off rollers in the direction of travel of said thread, said friction roller driving a yarn package to wind said thread onto said yarn package;

a plurality of electrically driven reluctance motors operably connected to said pairs of drafting rollers, said pair of drawing-off rollers, and said friction roller, said reluctance motors driving said pairs of drafting rollers, said pair of drawing-off rollers and said friction roller; and a plurality of frequency converters with at least one of said frequency converters operably connectable to each of said reluctance motors by a respective switch.

2. An air spinning frame having a plurality of spinning places for the production of spun thread from a supplied longitudinal fiber formation, each of said spinning places comprising:

a drafting unit having at least two pairs of drafting rollers, said drafting units drafting said longitudinal fiber formation;

a pair of drawing-off rollers positioned downstream from said drafting unit in a direction of travel of a formed thread created from fibers discharged from said drafting unit, said pair of drawing-off rollers transporting said thread after the formation of said thread;

a friction roller positioned downstream from said pair of drawing-off rollers in the direction of travel of said thread, said friction roller driving a yarn package to wind said thread onto said yarn package;

a plurality of electrically driven reluctance motors operably connected to said pairs of drafting rollers, said pair of drawing-off rollers, and said friction roller, said reluctance motors driving said pairs of drafting rollers, said pair of drawing-off rollers and said friction roller;

a plurality of frequency converters with at least one of said frequency converters operably connectable to each of said reluctance motors by a respective switch; and wherein said plurality of frequency converters comprises a plurality of first frequency converters and a plurality of second frequency converters with one of said first frequency converters and one of said second frequency converters operably connectable to each of said reluctance motors by said respective switch.

3. An air spinning frame as in claim 2, wherein said switches connect said second frequency converters to said reluctance motors during a stationary mode of operation for each of said reluctance motors and said switches connect said first frequency converters to said reluctance motors for a run-up mode for each of said reluctance motors.

4. An air spinning frame as in claim 3, wherein corresponding said reluctance motors of said plurality of spinning places are connected in parallel when said switches connect said second frequency converters to said reluctance motors.

5. An air spinning frame as in claim 1, wherein said switches comprise at least one of electronic switches or galvanic switches.

6. An air spinning frame as in claim 2, wherein said switches comprise a coupling for the controlling of a timed sequence of a switch over of each of said reluctance motors from a corresponding said first frequency converter to a corresponding said second frequency converter.

7. An air spinning frame as in claim 1, wherein an operating point of each of said reluctance motors is below a nominal point.

8. An air spinning frame as in claim 7, wherein a current intensity corresponding to the operating point is about 0.67 times a current intensity corresponding to said nominal point.

9. An air spinning frame as in claim 2, wherein said second frequency converters for each of said reluctance motors within said spinning place are connected by a common direct intermediate circuit.

10. An air spinning frame as in claim 1, wherein stators of said reluctance motors comprise a water cooling unit.

11. A method of operation of an air spinning frame having a plurality of spinning places for the production of spun thread from a supplied longitudinal fiber formation, the method comprising of the steps:

driving pairs of drafting rollers, a pair of drawing-off rollers and a friction roller by a plurality of reluctance motors within a spinning place;

connecting each of the reluctance motors within the spinning place to a corresponding first frequency converter with an assigned switch to run up the speeds of each of the reluctance motors to a predetermined speed proximal to a stationary operating speed for each of the reluctance motors; and switching each of the reluctance motors within the spinning place from the corresponding first frequency converter to a corresponding second frequency converter with the assigned switch once the speeds of each of the reluctance motors reach the respective predetermined speeds to run the reluctance motors at the stationary operating speeds for each of the reluctance motors.

12. A method as in claim 11, wherein the reluctance motors within the spinning place run-up synchronously to a supplied frequency based on a constant voltage-frequency ratio.

13. A method as in claim 11, wherein the speed reached during run-up for the reluctance motor for the drive of the pair of draw-off rollers is higher than the stationary operating speed for that reluctance motor to avoid thread tensioning.

14. A method as in claim 11, wherein the point in time of the switching of the reluctance motor for the drive of the friction roller from the corresponding first converter to the corresponding second converter for that reluctance motor lies before the point in time of the switching of the reluctance motor for the drive of the pair of draw-off rollers from the corresponding first converter to the corresponding second converter for that reluctance motor to avoid thread tensioning.

15. A method as in claim 11, wherein, after switching from the corresponding first converter to the corresponding second converter for the reluctance motors, each of the reluctance motors run-up to the stationary operating speed of that reluctance motor in a non-synchronous manner compared to the run-up of the other reluctance motors.

16. A method as in claim 11, wherein the second frequency converters for each of the reluctance motors within the spinning place are connected by a common direct intermediate circuit.

17. A method as in claim 16, wherein the second frequency converters are capable of a four-quadrant operation.

18. A method as in claim 17, wherein, during a power supply failure, the reluctance motor driving the friction roller at each spinning place acts as a generator and supplies generated electrical power to the reluctance motors driving the pair of drafting rollers and the pair of draw-off rollers to drive the air spinning frame during run down in a controlled manner to avoid thread breaks.

19. A method as in claim 18, wherein the direct current intermediate circuit is held at a constant voltage during run down of the air spinning frame.

* * * * *